US005868204A

United States Patent [19]

Pritchett et al.

[11] Patent Number: 5,868,204

[45] Date of Patent: Feb. 9, 1999

[54] TUBING HANGER VENT

[75] Inventors: Martin J. Pritchett; Norman Brammer, both of Aberdeen, Scotland

[73] Assignee: ABB Vetco Gray Inc., Houston, Tex.

[21] Appl. No.: 852,983

[22] Filed: May 8, 1997

[51] Int. Cl.[6] ..... E21B 34/10

[52] U.S. Cl. ..... 166/368; 166/88.4

[58] Field of Search ..... 166/368, 88.1, 166/88.4, 95.1, 97.1

[56] References Cited

U.S. PATENT DOCUMENTS 5,544,707 8/1996 Hopper et al. .
5,555,935 9/1996 Brammer et al. ..... 166/368

FOREIGN PATENT DOCUMENTS 1076763 9/1967 United Kingdom .
2286840 8/1995 United Kingdom .
WO-9607812 3/1996 WIPO .

*Primary Examiner*—William Neuder
*Attorney, Agent, or Firm*—James E. Bradley

[57] ABSTRACT

The internal tree cap of this invention has an isolation sleeve that stabs into a receptacle in the upper end of the tubing hanger. A seal on the exterior of the isolation sleeve seals an inner void within the isolation sleeve from an outer void. The inner void is the area between the tubing hanger wireline plug and the tree cap. The outer void is an area surrounding the tubing hanger above the tubing hanger upper seal and below the tree cap seal. The internal tree cap may have a bore and an upper crown plug that is wireline retrievable. Fluid will be trapped in the inner void when the isolation sleeve is stabbed into the receptacle above the tubing hanger. To allow displacement of the fluid when landing the upper crown plug, or when landing the upper crown plug and internal tree cap together, a vent passage leads through the tubing hanger to the outer void. This vent passage is preferably controlled by a metal sealing needle valve which is shut by an ROV or diver.

27 Claims, 5 Drawing Sheets

TUBING HANGER VENT

TECHNICAL FIELD

This invention relates in general to oil and gas well Christmas trees, and in particular to a tree cap for a horizontal tree.

BACKGROUND ART

One type of wellhead assembly, particularly used offshore, is known as a horizontal tree. The well has a wellhead housing which contains casing hangers, each secured to a string of production casing that extends into the well. The tree mounts on top of the wellhead housing. The tree has a vertical bore and a horizontal or lateral production flow outlet. A tubing hanger lands in the bore of the tree and is secured to a string of production tubing extending through the casing hangers and into the well. The tubing hanger has a lateral flow passage that registers with the lateral passage of the horizontal tree.

A plug, normally wireline retrievable, fits in the vertical passage of the tubing hanger above the lateral passage. A tree cap fits above the tubing hanger in the bore of the tree. The tree cap may have a vertical passage with a wireline retrievable crown plug or it may be a solid cap. A corrosion cap fits over the upper end of the tree.

A tubing annulus between the tubing and the casing communicates to a lower annulus port formed in the tree. This port leads through an annulus passage to an upper annulus port which extends into the bore of the tree above the tubing hanger seals. One or more valves are used to open and close the tubing annulus. The upper tubing annulus port communicates with a void that is located between the tubing hanger wireline plug and the seal of the internal tree cap. In the prior art, removing the crown plug from the internal tree cap will provide a communication between the upper tubing annulus port and the vertical passage in the internal tree cap.

DISCLOSURE OF INVENTION

The internal tree cap of this invention has an isolation sleeve that stabs into a receptacle in the upper end of the tubing hanger. A seal on the exterior of the isolation sleeve seals an inner void within the isolation sleeve from an outer void. The inner void is the area between the tubing hanger wireline plug and the tree cap. The outer void is an area surrounding the tubing hanger above the tubing hanger upper seal and below the tree cap seal. The internal tree cap may have a bore and an upper crown plug that is wireline retrievable.

Fluid will be trapped in the inner void when the isolation sleeve is stabbed into the receptacle above the tubing hanger. To allow displacement of the fluid when landing the upper crown plug, or when landing the upper crown plug and internal tree cap together, a vent passage leads through the tubing hanger to an external valve. This vent passage is preferably controlled by a metal sealing needle valve which is shut by an ROV or diver.

BRIEF DESCRIPTION DRAWINGS

BEST MODE FOR CARRYING OUT THE INVENTION

Figure 1:
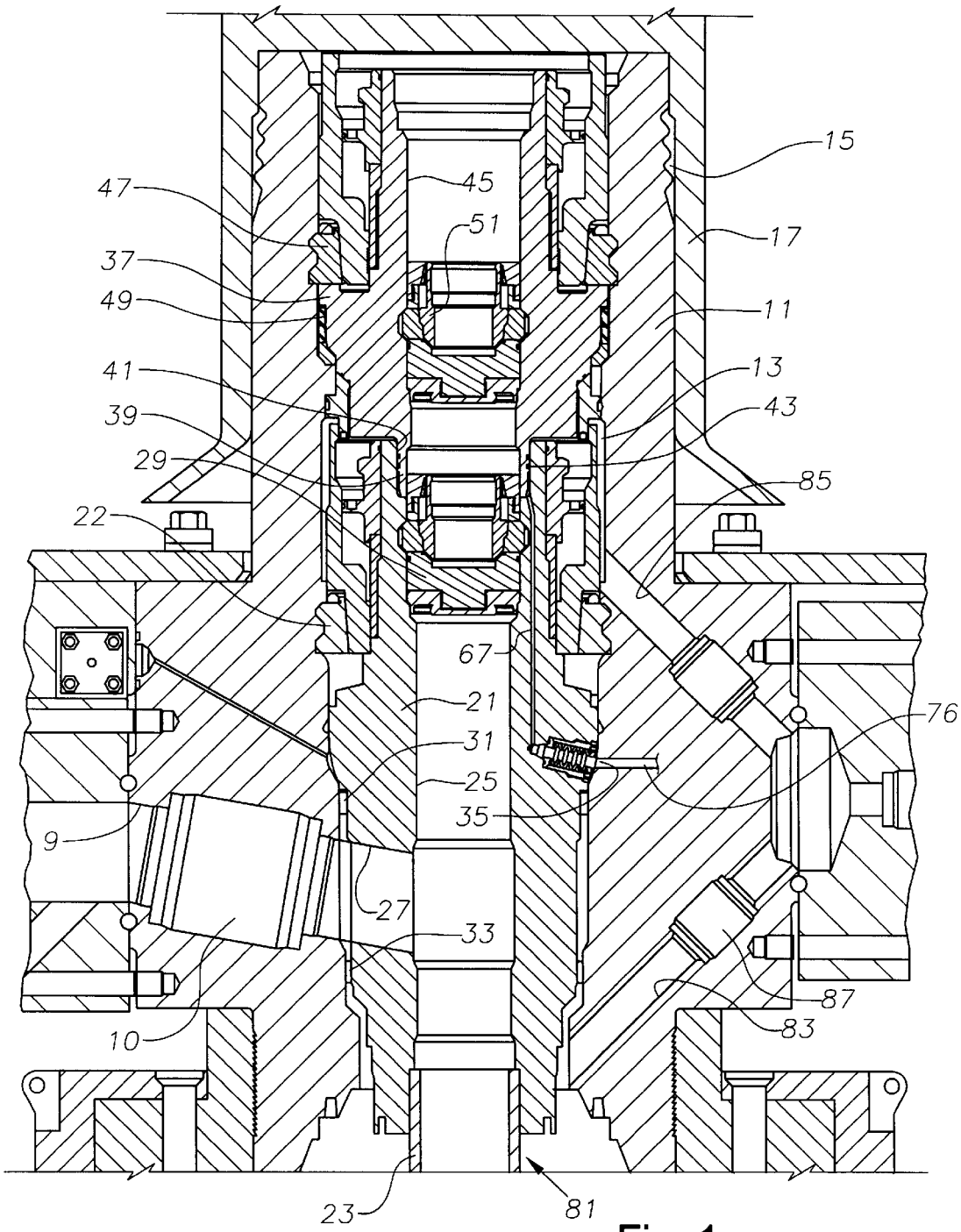
FIG. 1 is a vertical sectional view of a portion of a horizontal tree constructed in accordance with this invention.

Referring to FIG. 1, Christmas tree 11 is of a type known as a horizontal tree. It has a vertical or axial tree bore 13 extending completely through it. A set of grooves 15 are located on the exterior near the upper end for connection to a drilling riser. A removable corrosion cover 17 fits over the upper end of tree 11. Tree 11 has a lateral production passage 19 that extends generally horizontally from bore 13 and is controlled by a valve 20. Tree 11 will be landed on top of a wellhead housing (not shown) which has casing extending into a well.

A tubing hanger 21 lands sealingly in bore 13. Tubing hanger 21 is secured to tree 11 by a lock down mechanism 22. A string of production tubing 23 extends through the casing hangers (not shown) into the well for the flow of production fluid. Production tubing 23 communicates with a vertical passage 25 that extends through tubing hanger 21. A lateral passage 27 extends from vertical passage 25 and aligns with tree lateral passage 19.

A wireline retrievable plug 29 will lock in vertical passage 25, sealing the upper end of vertical passage 25. Tubing hanger 21 has an upper seal 31 located above lateral passage 27 and a lower seal 33 located below lateral passage 27. Seals 31, 33 seal to bore 13 of tree 11. A radial port 35 in tubing hanger 21 communicates with a passage 67 that extends upward through tubing hanger 21.

Figure 3:
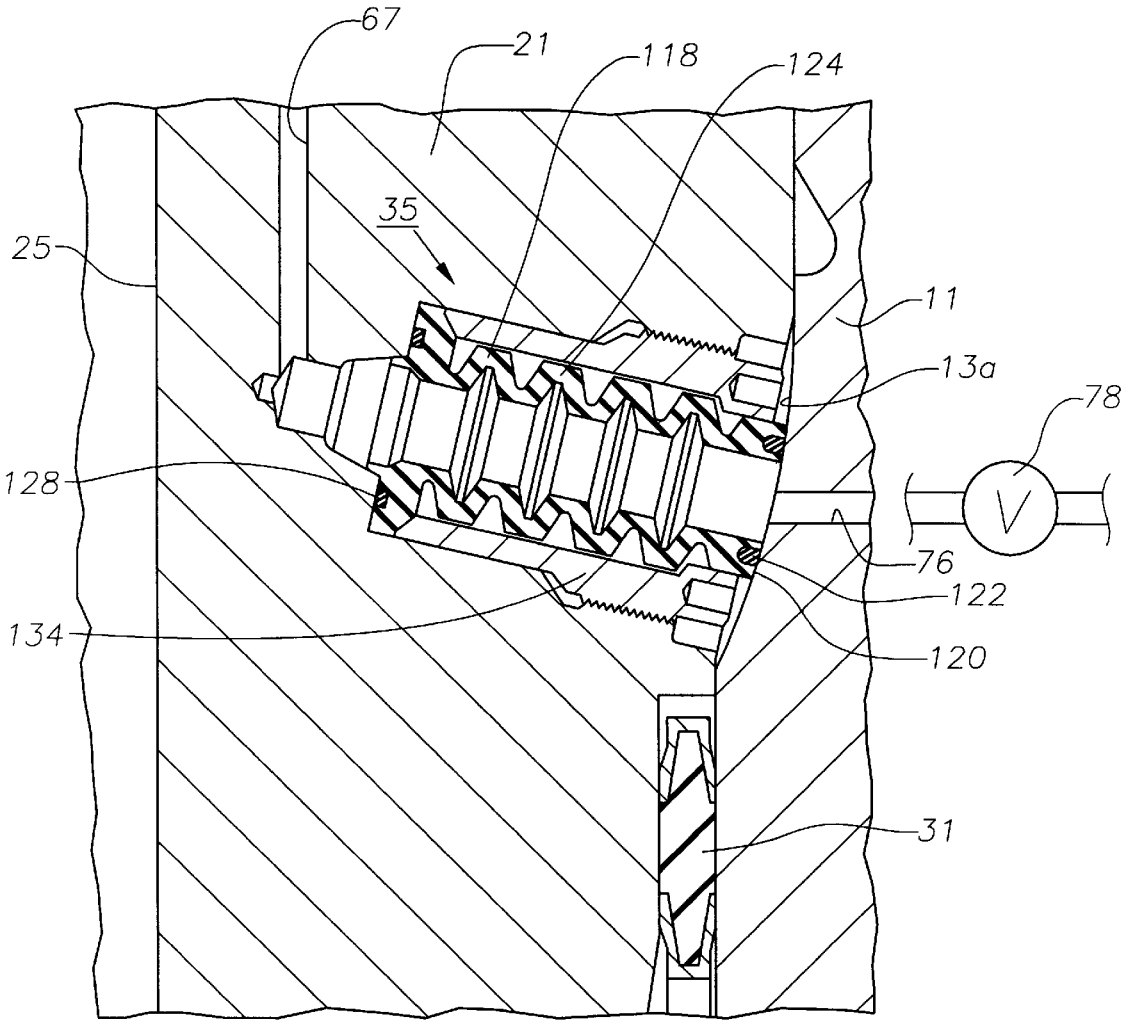
FIG. 3 is an enlarged view of a seal for the vent passage of the horizontal tree of FIG. 1.

In the preferred embodiment (FIG. 3), a seal member 118 seals against a spherical sidewall port 13*a* of bore 13. Seal member 118 is metal, tubular and located within port 35. Seal member 118 has a metal seal 120 on its face and elastomeric seals 122, 128 located on its outer ends. Seal member 118 also has a tubular sidewall 124. A retainer 134 surrounds seal member 118 to hold it in port 35. A passage 76 leads from port 35 through tree 11 to an outer valve 78 which controls port 35. Outer valve 78 is a metal sealing needle valve which is operated by an ROV or a diver after installation when retrieval operations are complete.

Figure 2:
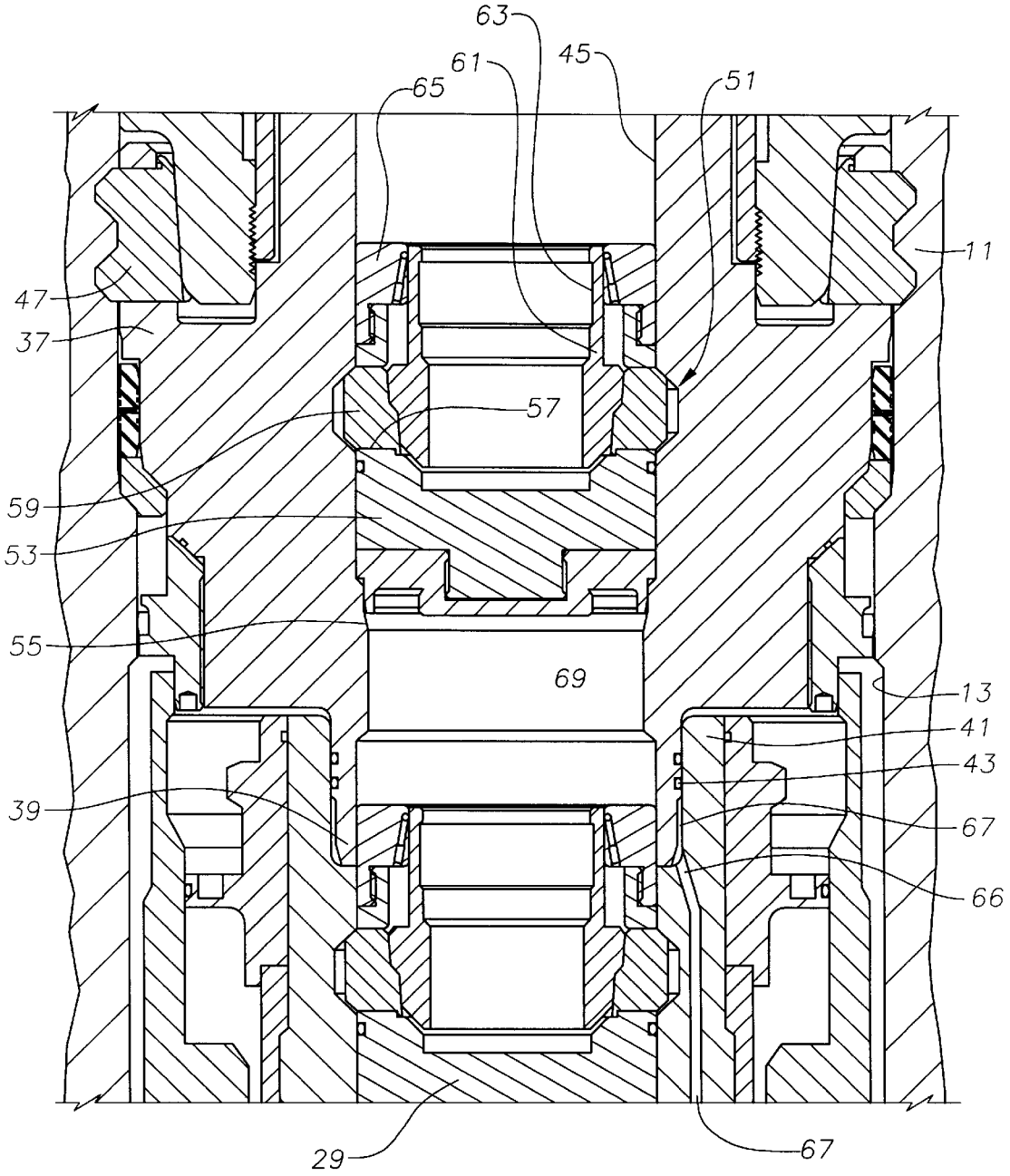
FIG. 2 is an enlarged view of the internal tree cap of the horizontal tree of FIG. 1.

Referring to FIGS. 1 and 2, a tree cap 37 inserts sealingly into tree bore 13 above tubing hanger 21. Tree cap 37 has a downward depending isolation sleeve 39 that is coaxial. Sleeve 39 fits within a receptacle 41 formed on the upper end of tubing hanger 21. Passage 67 communicates with a vent port 66 located at the interface between sleeve 39 and receptacle 41. Seals 43 located on sleeve 39 seal to receptacle 41 above vent port 66. The interior of sleeve 39 communicates with an axial passage 45 that extends through tree cap 37. Axial passage 45 has approximately the same inner diameter as tubing hanger passage 25. A locking mechanism 47 similar to that of the tubing hanger locking mechanism 22 is used to lock tree cap 37 to tree 11. A seal 49 seals tree cap 37 to tree bore 13.

An upper wireline retrievable crown plug 51 inserts into tree cap passage 45. Referring to FIG. 2, crown plug 51 has a body 53 with a metal seal 55 on its lower end. Metal seal 55 is a depending lip that engages a tapered surface in passage 45. Body 53 has a plurality of windows 57 which allow dogs 59 to extend and retract. Dogs 59 are pushed outward by a central cam member 61. Cam member 61 has a profile 63 on its upper end for engagement by a running tool. Cam member 61 moves between a lower position shown and an upper position freeing dogs 59 to retract. A retainer 65 secures to the upper end of body 53 to retain cam member 61.

Referring again to FIG. 1, a tubing annulus 81 surrounds tubing 23 between tubing 23 and the smallest diameter string of casing (not shown). Tubing annulus 81 communicates with a lower annulus passage 83 that extends from tree bore 13 through the wall of tree 11 below tubing hanger seal 33. Lower annulus passage 83 communicates with an upper annulus passage 85 that extends into tree bore 13 above tubing hanger seal 31 and below tree cap seal 49. Valves 87 are located in annulus passages 83, 85.

In operation, after the well has been drilled and cased, the operator lowers tree 11 onto the wellhead housing (not shown). The operator then may install production tubing 23. Tubing hanger 21 lands in bore 13 with its passage 27 aligning with horizontal passage 19. Wireline plug 29 may be installed with a wireline tool.

Wireline plug 51 will be installed and tested in tree cap 37 at the rig. Then, tree cap 37 is lowered on a string of conduit, such as drill pipe. Isolation sleeve 39 will stab into receptacle 41 as locking mechanism 47 locks tree cap 37 to bore 13. Excess fluid trapped between plugs 29, 51 may flow out vent passage 67, through radial port 35, passage 76 and valve 78.

For a workover operation in which tubing 23 needs to be pulled, a drilling riser can be employed. After removal of corrosion cap 17, the operator installs a drilling riser to profile 15, the drilling riser having a blowout preventer (not shown). The operator will lower a drill string into engagement with tree cap 37 and retrieve it. After pulling internal tree cap 37, the operator may circulate a kill fluid to kill the well.

To do so, the operator installs an inner riser string (not shown) which stabs into receptacle 41 of tubing hanger 21. Pipe rams (not shown) in the drilling riser are closed around the inner riser string. Upper tubing annulus passage 85 now communicates with an annulus surrounding the inner riser, which in turn communicates with choke and kill lines leading alongside the riser back to the drilling rig. The operator will pull wireline plug 29 with a wireline tool. A port (not shown) at the lower end of tubing 23 will be opened to communicate the interior of tubing 23 with tubing annulus 81. This may be done with a wireline tool in a conventional manner. With production valve 20 closed and tubing annulus valve 87 open, the operator can pump down the inner riser, down tubing 23 and back up tubing annulus 81. The annulus fluid circulates through annulus passages 83, 85, up tree bore 13 and through the choke and kill lines to the surface. After the kill fluid has been placed in the well, the operator may pull production tubing 23.

Under some circumstances, an operator may wish to achieve wireline intervention into tubing 23 without killing the well and without using the drilling riser. Wireline access is achievable with the well under flowing conditions. A wireline riser (not shown) will be installed in the upper portion of passage 45 of tree cap 37. The operator can use a wireline tool to engage crown plug 51. The operator will retrieve plugs 51, 29 in a conventional manner to perform the wireline intervention. Plugs 51, 29 may be reinstalled conventionally. Vent port 67 avoids hydraulic lock when landing plug 51.

Figure 4:
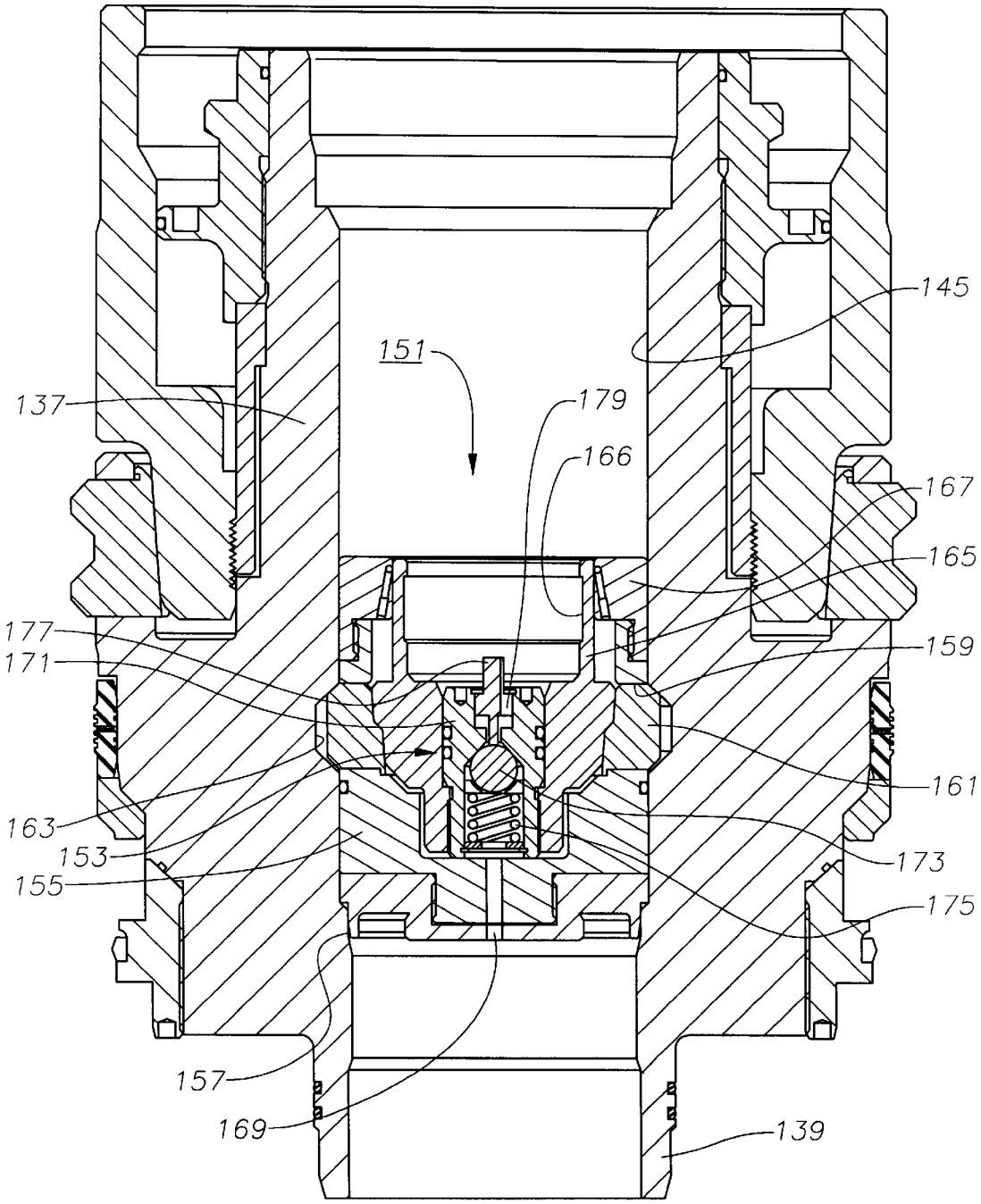
FIG. 4 is an enlarged sectional view of a second embodiment of the invention.

Referring to FIG. 4, a second embodiment of the invention is shown. A wireline retrievable crown plug 151 inserts into a tree cap passage 145 in an internal tree cap 137. Crown plug 151 has a vent check valve 153 that when opened will allow pressure from below to vent upward above check valve 153. Check valve 153 has a body 155 which has a metal seal 157 secured to its lower end. Seal 157 is a depending lip that seals against a tapered surface formed in tree cap passage 145. Body 155 has a plurality of windows 159 which allows dogs 161 to protrude through. When in the outer locked position, dogs 161 will engage a groove 163 in tree cap passage 45. A cam member 165 is carried reciprocally within body 155. When in the lower position, cam member 165 keeps dogs 161 in the outer locked position. When cam member 165 is pulled upward, it will allow dogs 161 to retract from groove 163. Cam member 165 has a profile 166 on its upper end to allow engagement of a running and retrieval tool (not shown). A retainer 167 secures to the upper end of body 155 to retain cam member 165. A vent port 169 extends axially through body 155 to the lower end of cam member 165.

Check valve 153 is located within a cavity in cam member 165. Check valve 153 includes a valve body 171 carried within an axial cavity in cam member 165. A ball 173 is urged upward by a spring 175 against a seat for blocking any flow from below. A plunger 177 extends upward from valve body 171. Plunger 177 can be stroked downward by the running tool, and moves upward in response to the force of spring 175. When stroked downward from the position shown, it pushes ball 173 downward, allowing upward flow past the seat. Plunger 177 has a flow channel 179 to allow flow of fluid in an upward direction when it is pushed downward.

Preferably, crown plug 151 will be installed in tree cap 37 and pressure tested while tree cap 137 is at the drilling rig. Tree cap 137 will be lowered on a running tool on drill pipe. Check valve 153 will be held in an open position while isolation sleeve 139 stabs into a receptacle (not shown). Preferably this is handled by a mechanical device on the lower end of the running tool (not shown). The open position of check valve 153 allows displacement of trapped fluid between wireline plugs 29, 151. The fluid flows up vent passage 169 and through check valve 153 into tree cap passage 45 above crown plug 151. After installation and testing, the running tool is retrieved, causing check valve 153 to close due to the force of spring 175. Check valve 153 serves as a second pressure barrier to the wireline plug in the tubing hanger.

For a workover operation requiring the pulling of tubing 23 (FIG. 1), the operator may use a drilling riser and blowout preventer stack (not shown). Normally, a kill fluid will be circulated into the well which is heavier than the well fluid to prevent a blowout. The operator will land a running tool on internal tree cap 37, which at the same time depresses plunger 177 to vent any pressure buildup in an inner void 188 between the two wireline plugs 29, 151. This will inform the operator whether or not the tubing hanger wireline plug had been leaking.

The operator then pulls internal tree cap 37 and runs back in with an inner riser string (not shown) which stabs into the receptacle of the tubing hanger. Pipe rams (not shown) in the drilling riser are closed around the inner riser string. Upper tubing annulus passage 85 (FIG. 1) now communicates with an annulus surrounding the inner riser, which in turn communicates with choke and kill lines leading alongside the riser back to the drilling rig. The operator will pull wireline plug 29 (FIG. 1) with a wireline tool. A port (not shown) at the lower end of tubing 23 will be opened to communicate the interior of tubing 23 with tubing annulus 81. This may be done with a wireline tool in a conventional manner. With production valve 20 (FIG. 1) closed and tubing annulus valve 87 open, the operator can pump down the inner riser, down tubing 23 and back up tubing annulus 81. The annulus fluid circulates through annulus passages 83, 85, up tree bore 13 and through the choke and kill lines to the surface. After the kill fluid has been placed in the well, the operator may pull production tubing 23.

Under some circumstances, an operator may wish to achieve wireline intervention into tubing 23 without killing the well and without using the drilling riser.

Wireline access is achievable with the well under flowing conditions. A wireline riser (not shown) will be installed in the upper portion of passage 145 of tree cap 137. The operator can use a wireline tool to engage crown plug 151. Check valve 153 will be opened to vent off any pressure buildup that might exist in inner void 188 between tubing hanger wireline plug 29 and crown plug 151. The operator will retrieve plugs 151, 29 in a conventional manner to perform the wireline intervention. When reinstalling crown plug 151, check valve 153 will be opened to allow displacement of trapped fluid in inner void 188.

Figure 5:
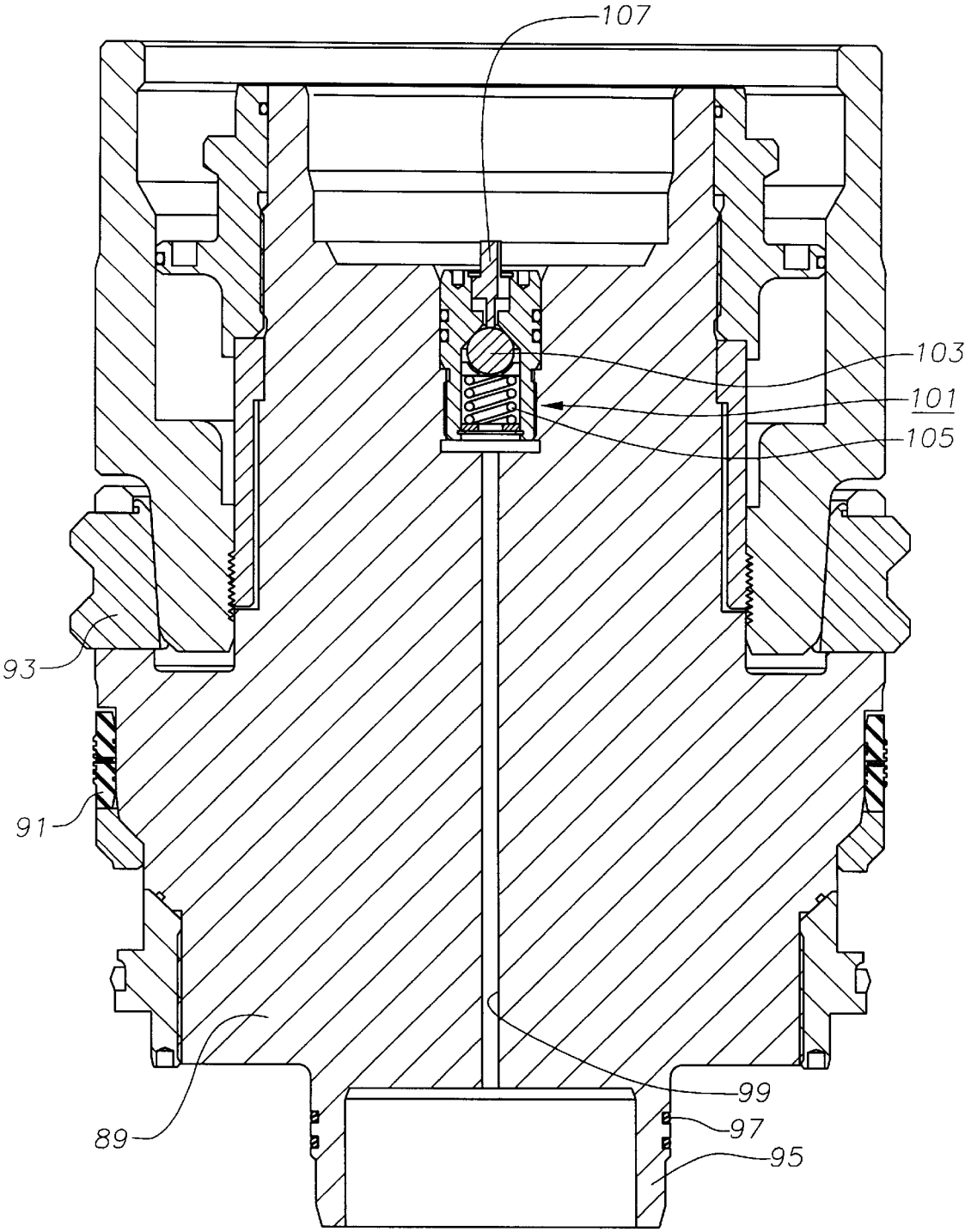
FIG. 5 is an enlarged sectional view of a third embodiment of the invention.

A third embodiment is shown in FIG. 5. In this embodiment, there is no wireline plug, such as crown plug 151 contained within tree cap 137 (FIG. 4). Instead, tree cap 89 is a solid plug having no means for allowing wireline intervention. Tree cap 89 has a seal 91 that seals to bore 13. A locking mechanism 93 will lock tree cap 89 to tree 11. Tree cap 89 has an isolation sleeve 95 that extends into receptacle 41 of tubing hanger 21. Sleeve 95 has seals 97 for sealing to receptacle 41.

A vent passage 99 extends through tree cap 89 along its axis. Vent passage 99 is a small passage, not sufficiently large to accommodate a crown plug such as crown plug 51. A check valve 101 is mounted to the upper end of vent passage 99. Check valve 101 is similar to check valve 153. It has a ball 103 which is urged upward by a spring 105 against a seat. A plunger 107 operated by a running tool will depress ball 103 to allow venting of trapped fluid during installation of tree cap 89.

The invention has several advantages. The vent port vents fluid from the inner void when landing the upper crown plug, or when landing the upper crown plug and internal tree cap together. The vent port also admits fluid to the void when retrieving the upper crown plug and/or the internal tree cap, thus preventing a vacuum from being formed. In addition, the vent port detects and/or vents build-up pressure in the region due to a leakage in the lower plug. Finally, the vent port permits a pressure test to be carried out on the seals of the upper crown plug and the stab sub of the internal tree cap. The vent port allows separate pressure monitoring of the tubing annulus from the crown plug.

While the invention has been shown in only three of its forms, it should be apparent to those skilled in the art that it is not so limited, but is susceptible to various changes without departing from the scope of the invention.

We claim:

1. A wellhead assembly, comprising in combination:

a christmas tree having an axial bore and a lateral production passage;

a tubing hanger landed in the bore of the tree and having a lateral opening that aligns with the lateral production passage in the tree and an axial bore;

a retrievable plug landed in the bore of the tubing hanger above the lateral opening;

an internal tree cap assembly landed in the bore of the tree above the tubing hanger, the tree cap assembly having a downward depending isolation sleeve which extends into the bore of the tubing hanger;

a seal on the isolation sleeve which seals in the bore of the tubing hanger, creating a void between the plug and the internal tree cap; and a vent passage leading from the void for avoiding fluid lock in the void between the plug and the tree cap assembly when the tree cap assembly is landed in the bore of the tree.

2. The wellhead assembly of claim 1, further comprising a valve for opening and closing the vent passage.

3. The wellhead assembly of claim 1, further comprising a check valve in the vent passage which prevents flow from the void when in a closed position and allows flow from the void when in an open position.

4. The wellhead assembly of claim 1 wherein the vent passage is in the tree cap assembly.

5. The wellhead assembly of claim 1 wherein the vent passage extends through the tubing hanger and christmas tree to an exterior.

6. The wellhead assembly of claim 1, further comprising:

an axial bore in the tree cap assembly; and a second retrievable plug landed in the bore of the tree cap assembly.

7. The wellhead assembly of claim 1, further comprising:

an axial bore in the tree cap assembly;

a second retrievable plug landed in the bore of the tree cap assembly; and wherein the vent passage is in the second plug and further comprising a check valve in the vent passage in the second plug for allowing trapped fluid to be expelled above the second plug when the check valve is in an open position.

8. The wellhead assembly of claim 1 wherein the vent passage leads axially through the tree cap assembly; and further comprising a check valve in the vent passage for releasing fluid trapped between the tree cap and the plug when the check valve is in an open position.

9. In a wellhead assembly having a christmas tree with an axial bore, a lateral production passage, and a tubing hanger landed in the bore of the tree, the tubing hanger having an axial bore and a lateral opening that aligns with the lateral production passage in the tree, the improvement comprising:

a first retrievable plug landed in the bore of the tubing hanger above the lateral opening;

an internal tree cap assembly landed in the bore of the tree above the tubing hanger, the tree cap assembly having an axial bore and a downward depending isolation sleeve which extends into the bore of the tubing hanger;

a seal on the isolation sleeve which seals in the bore of the tubing hanger, creating a void between the first plug and the internal tree cap;

a second retrievable plug landed in the bore of the tree cap assembly;

a vent passage communicating with the void for expelling fluid trapped between the plugs when the tree cap assembly is landed in the bore of the tree; and a valve for opening and closing the vent passage.

10. The wellhead assembly of claim 9 wherein the vent passage is in the second plug and wherein the valve is a check valve that allows fluid to be expelled from the void when moved to an open position.

11. The wellhead assembly of claim 9 wherein the vent passage extends through the tree cap assembly.

12. The wellhead assembly of claim 9 wherein the vent passage extends through the tubing hanger and the tree to an exterior.

13. The wellhead assembly of claim 9 wherein the vent passage leads axially through the tree cap assembly and the valve is a check valve that allows fluid to be expelled from the void when moved to an open position.

14. A wellhead assembly, comprising in combination:

a christmas tree having an axial bore and a lateral production passage;

a tubing hanger landed in the bore of the tree and having a lateral opening that aligns with the lateral production passage in the tree and an axial bore;

a first retrievable plug landed in the bore of the tubing hanger above the lateral opening;

an internal tree cap landed in the bore of the tree above the tubing hanger, the tree cap having a downward depending isolation sleeve which extends sealingly into the bore of the tubing hanger creating a void between the tree cap and the first plug;

a check valve in the tree cap in communication with the void and adapted to be held in an open position when the tree cap is landed in the bore of the tree so that fluid may be released from the void to avoid fluid lock.

15. The wellhead assembly of claim 14 wherein the tree cap has a bore; and further comprising a second retrievable plug located in the bore of the tree cap; and wherein the check valve is located within the second plug.

16. The wellhead assembly of claim 14 wherein the tree cap is solid and has an axial passage; and wherein the check valve is located in the axial passage of the tree cap, the axial passage communicating with the check valve and the void.

17. The wellhead assembly of claim 14 wherein the check valve further comprises:

a valve body having a flow channel and a seat;

a spring;

a ball which is urged upward by the spring against the seat for blocking fluid from the void;

a plunger which moves upward in response to the spring; and means for urging the plunger downward so that fluid may be released through the flow channel from the void when the tree cap is landed in the bore of the tree.

18. In a wellhead assembly having a christmas tree with an axial bore, a lateral production passage, and a tubing hanger landed in the bore of the tree, the tubing hanger having an axial bore and a lateral opening that aligns with the lateral production passage in the tree, the improvement comprising:

a first retrievable plug landed in the bore of the tubing hanger above the lateral opening;

an internal tree cap assembly landed in the bore of the tree above the tubing hanger, the tree cap assembly having an axial bore and a downward depending isolation sleeve which extends into the bore of the tubing hanger;

a seal on the isolation sleeve which seals in the bore of the tubing hanger, creating a void between the first plug and the internal tree cap;

a second retrievable plug landed in the bore of the tree cap assembly;

a vent passage leading through the tubing hanger between the isolation sleeve and the tubing hanger to an exterior of the tree for expelling fluid trapped between the plugs when the tree cap assembly is landed in the bore of the tree; and a valve for opening and closing the vent passage.

19. A method for avoiding fluid lock in a wellhead assembly, comprising:

(a) providing a christmas tree having an axial bore and a lateral production passage;

(b) landing a tubing hanger in the bore of the tree, the tubing hanger having a lateral opening that aligns with the lateral production passage in the tree and an axial bore;

(c) landing a retrievable plug in the bore of the tubing hanger above the lateral opening;

(d) landing an internal tree cap assembly in the bore of the tree above the tubing hanger, the tree cap assembly having a downward depending isolation sleeve which extends into the bore of the tubing hanger;

(e) sealing the isolation sleeve with a seal in the bore of the tubing hanger, creating a void between the plug and the internal tree cap; and then (f) releasing fluid trapped in the void through a vent port for avoiding fluid lock in the void between the plug and the tree cap assembly when the tree cap assembly is landed in the bore of the tree.

20. The method of claim 19 wherein step (f) comprises releasing fluid through the vent port to an exterior of the tree.

21. The method of claim 19 wherein step (f) comprises releasing fluid through the vent port and into a vent passage in the tree cap assembly.

22. The method of claim 19 wherein step (f) comprises releasing fluid through the vent port and into a vent passage in the tubing hanger.

23. A method for avoiding fluid lock in a wellhead assembly, comprising:

(a) providing a christmas tree having an axial bore and a lateral production passage;

(b) landing a tubing hanger in the bore of the tree, the tubing hanger having a lateral opening that aligns with the lateral production passage in the tree and an axial bore;

(c) landing a first retrievable plug in the bore of the tubing hanger above the lateral opening;

(d) landing an internal tree cap assembly in the bore of the tree above the tubing hanger, the tree cap assembly having a downward depending isolation sleeve which extends into the bore of the tubing hanger;

(e) landing a second retrievable plug in the bore of the tree cap assembly;

(f) sealing the isolation sleeve with a seal in the bore of the tubing hanger, creating a void between the plugs; and then (g) releasing fluid trapped in the void through a vent port for avoiding fluid lock in the void between the plugs when the tree cap assembly is landed in the bore of the tree.

24. The method of claim 23 wherein step (g) comprises releasing fluid through the vent port and into a vent passage having a valve.

25. The method of claim 23 wherein step (g) comprises releasing fluid through the vent port and into a vent passage in the tree cap assembly.

26. The method of claim 23 wherein step (g) comprises releasing fluid through the vent port and into a vent passage in the tubing hanger.

27. A method for avoiding fluid lock in a wellhead assembly, comprising:

(a) providing a christmas tree having an axial bore and a lateral production passage;

(b) landing a tubing hanger in the bore of the tree, the tubing hanger having a lateral opening that aligns with the lateral production passage in the tree and an axial bore;

(c) landing a retrievable plug in the bore of the tubing hanger above the lateral opening;

(d) landing an internal tree cap assembly in the bore of the tree above the tubing hanger, the tree cap assembly having a downward depending isolation sleeve which extends into the bore of the tubing hanger;

(e) sealing the isolation sleeve with a seal in the bore of the tubing hanger, creating a void between the plug and the internal tree cap; and (f) providing a check valve in the tree cap assembly for avoiding fluid lock in the void between the plug and the tree cap assembly when the tree cap assembly is landed in the bore of the tree; and then (g) opening the check valve so that fluid may be released from the void.

* * * * *